US005344253A

United States Patent [19]

Sacchetti

[11] Patent Number: 5,344,253

[45] Date of Patent: Sep. 6, 1994

[54] ADJUSTABLE MANHOLE COVER

[76] Inventor: Cesare Sacchetti, 36 Enniskillen Avenue, Thunder Bay, Ontario, Canada, P7B 4L7

[21] Appl. No.: 114,392

[22] Filed: Sep. 1, 1993

[51] Int. Cl.[5] ..... E02D 29/14

[52] U.S. Cl. ..... 404/26; 404/25; 52/20; 52/21

[58] Field of Search ..... 404/25, 26; 52/20, 21; 210/163, 164

[56] References Cited

U.S. PATENT DOCUMENTS

| | | | |
|---|---|---|---|
| 1,076,386 | 10/1913 | O'Day | 404/26 |
| 1,165,044 | 12/1915 | Tyler | 404/26 |
| 2,930,295 | 3/1960 | Hale | 404/26 |
| 3,392,640 | 7/1968 | Zeile | 404/26 |
| 3,611,889 | 10/1971 | Levinson . | |
| 3,773,428 | 11/1973 | Bowman | 404/26 |
| 3,858,998 | 1/1975 | Larsson et al. | 404/26 |
| 4,075,796 | 2/1978 | Cuozzo | 52/20 |
| 4,149,816 | 4/1979 | Piso | 404/26 |
| 4,197,031 | 4/1980 | Hild | 404/26 |
| 4,273,467 | 6/1981 | Cronk | 404/26 |
| 4,281,944 | 8/1981 | Bowman | 404/26 |
| 4,925,337 | 5/1990 | Spiess et al. | 404/26 |
| 5,054,956 | 10/1991 | Huang | 404/26 |

*Primary Examiner*—Ramon S. Britts
*Assistant Examiner*—Pamela Anne O'Connor
*Attorney, Agent, or Firm*—Stanley E. Johnson

[57] ABSTRACT

An adjustable manhole cover support frame that includes a base unit, a top support unit telescopically arranged on the base unit and screw jacks interconnecting the two units permitting selectively adjusting the relative telescopic position of the top unit on the base unit. The base unit has an open ended sleeve projecting upwardly from a flange utilized to secure the base unit to the top end of a manhole vertical conduit. The top support unit has a top annular plate from which depends three cylindrical walls defining a first outer cavity telescopically receiving the sleeve of the base unit and inwardly therefrom a second cavity with holes in the bottom to receive the upper ends of threaded bolts that provide the screw jacks for adjustment.

11 Claims, 4 Drawing Sheets

ADJUSTABLE MANHOLE COVER

FIELD OF INVENTION

This invention relates to an improved adjustable manhole cover frame utilizing screw jacks to selectively alter the vertical position of the manhole cover support.

BACKGROUND OF INVENTION

Manholes are utilized for access purposes to underground conduits of utility lines and sewers. In the case of underground sanitary sewage infrastructure systems the manholes are usually installed with the entry-exit on a road surface. A concrete manhole conduit, or pipe, branches from the sewer and ultimately terminates at the road surface level where it is topped with a cast iron manhole unit and sealed from vehicles and pedestrians by a removable heavy cast iron manhole cover. The existing manhole units are approximately 7 inches in height and approximately 36 inches in diameter.

Since the manhole unit rests on a concrete manhole pipe that is connected to the underground sewage pipe system the manhole's absolute elevation remains fixed over time. However, in many cases the surface elevation will vary (up or down) over seasons and time. This is particularly prevalent in geographic locales that have a wide variance in climatic conditions from season to season and particularly where there is freezing and thawing conditions. As a result of ground shifts and heaving the manhole cover may dip below the road grade or protrude above and repairs associated with such elevation disparities are very costly for municipalities.

Even without adverse shifting of the road base, streets are periodically resurfaced for various reasons by the addition of paving material which may add one or two inches to the thickness of the existing surface. Driving over sunken or protruding manhole units results in vehicle damage as well as annoyance for the motorist. Motorists sometimes attempt to swerve to avoid protruding or sunken manhole units and such swerving can pose a safety threat to other motorists, cyclists, pedestrians or whomever may happen to be in the immediate vicinity. Cyclists not only face the same annoyances experienced by motorists but also face a greater threat to their physical safety.

Manhole units require considerable ongoing repairs if they are to remain unobtrusive on the driving surface. Repairs are not only expensive and time consuming but also disruptive to traffic flows. The repairs made do not fix the problem but only make temporary mends so long as the earth continues to heave and settle with resultant persistent elevational changes.

Numerous proposals have been made to overcome the foregoing problems by providing manhole units which can be adjustably varied in height and by way of example some of these proposals are illustrated in the following U.S. Pats.:

| | | |
|---|---|---|
| 4,273,467 | issued | June 16, 1981 |
| 4,149,816 | issued | April 17, 1979 |
| 3,858,998 | issued | January 7, 1975 |
| 3,773,428 | issued | November 20, 1973 |
| 3,392,640 | issued | July 19, 1968 |
| 2,930,295 | issued | March 29, 1960 |
| 1,076,836 | issued | October 21, 1913 |
| 4,925,337 | issued | May 15, 1990 |
| 4,281,944 | issued | August 4, 1981 |

-continued

| | | |
|---|---|---|
| 4,197,031 | issued | April 8, 1980 |
| 3,611,889 | issued | October 12, 1971 |
| 4,075,796 | issued | February 28, 1978 |
| 1,165,044 | issued | December 21, 1915 |
| 5,054,956 | issued | October 8, 1991 |

While the foregoing do provide for adjustability of the manhole cover support so as to bring the upper surface flush with the road surface they are not particularly practical because of the adjustment mechanisms being exposed in what might be considered a hostile environment. While some of the designs in theory should accomplish the desired results, their practicalities are not always favourable because of water, salt, sand, dust and the like environmental hostilities which can readily contact the exposed adjusting mechanism. Other proposed designs are complicated and thus expensive to manufacture.

SUMMARY OF INVENTION

A principal object of the present invention is to provide an adjustable manhole cover support frame wherein the adjusting mechanism and overlapping relatively movable parts of the frame are not directly exposed to the environmental hostilities mentioned above.

In keeping with the foregoing there is provided in accordance with the present invention an adjustable manhole cover support frame comprising:

(a) a base unit having an open ended sleeve with flange means on a bottom end portion thereof, said flange means extending laterally of said sleeve and securable with respect to an upper end portion of a manhole vertical conduit means providing an upward extension thereof;

(b) a top manhole cover support unit adjustably and telescopically supported on said base unit, said top unit having a top annular plate with a first outer annular wall and a second inner annular wall extending downwardly therefrom, said inner and outer walls being spaced apart from one another providing a first cavity on the underside of said unit with said first cavity being open only at its bottom end and telescopically receiving therein the open-ended sleeve of said base unit; said top unit having second cavity means adjacent and radially inwardly of said first cavity means; said second cavity means also being open only at a bottom end thereof for screw jacks to project thereinto; and (c) screw jack means for selectively adjusting the relative telescopic position of said base unit and said top unit; said screw jack means comprising a plurality of spaced apart rods projecting through the open bottom end of said second cavity and each rod having a nut threaded thereon which act against a bottom end said top unit; each said rod having a lower end portion engaging said flange means on said base member for support thereby.

The foregoing defined arrangement is readily adjustable with the screw jack adjusting means being relatively protected from the elements of the hostile environment and thereby being operative for adjustment over long periods of time while in use.

LIST OF DRAWINGS

The inventions is illustrated by way of example in the accompanying drawings wherein.

DESCRIPTION OF PREFERRED EMBODIMENT

Figure 1:
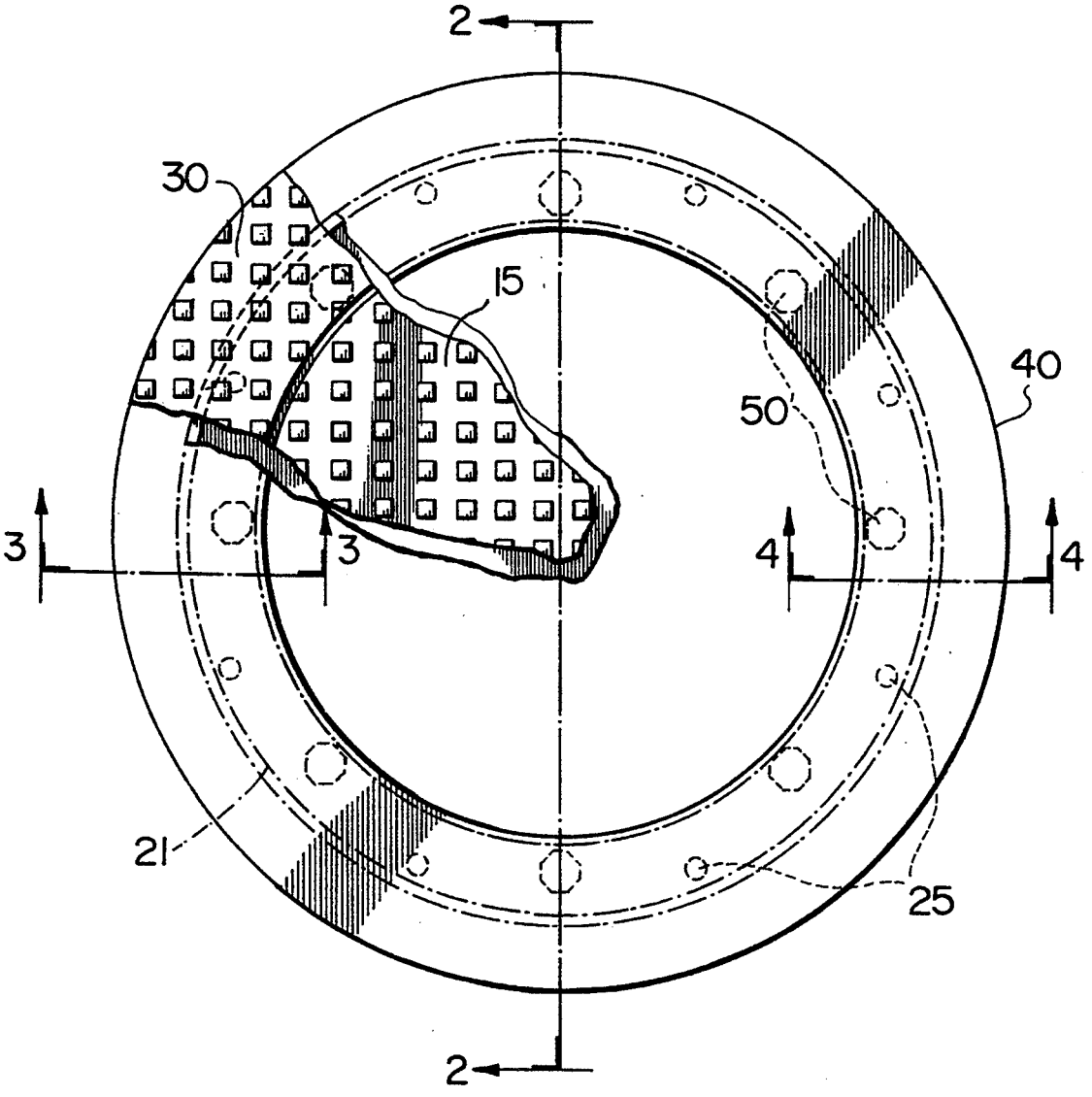
FIG. 1 is a top plan view of an adjustable manhole cover and support according to the present invention.
Figure 2:
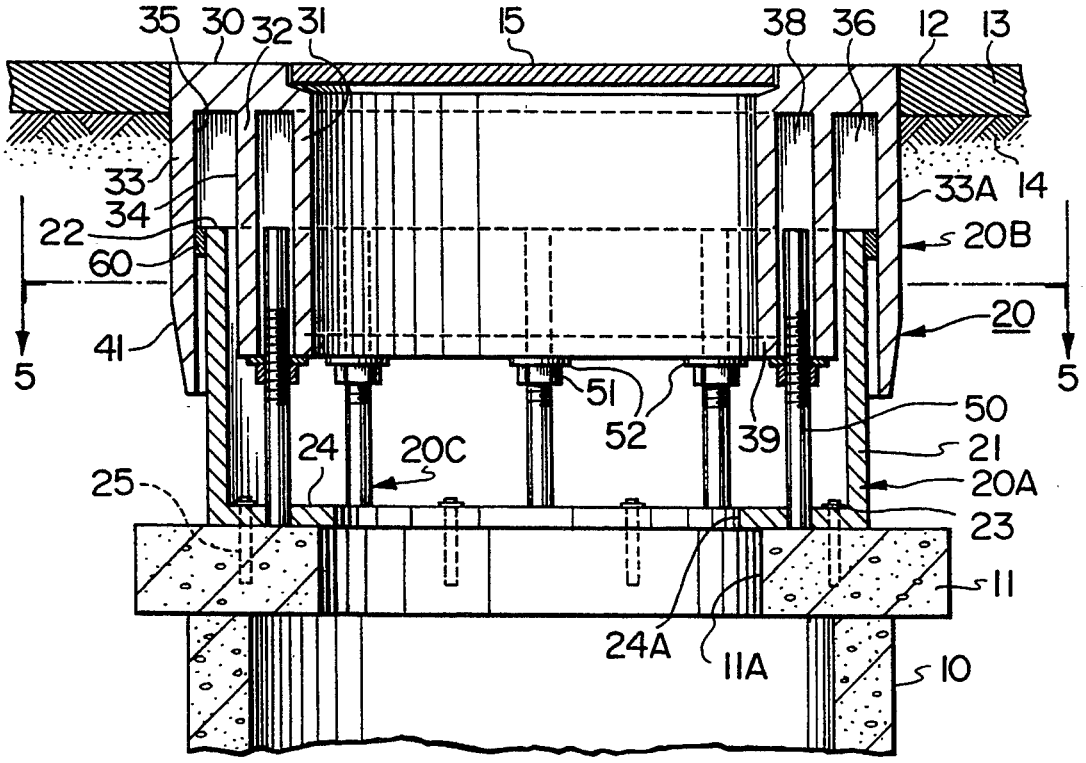
FIG. 2 is a vertical section taken essentially along line 2—2 of FIG. 1.

Referring to FIG. 2 there is illustrated a vertical manhole pipe 10 having a cap 11 thereon both of which are conventional concrete units. The vertical pipe 10 connects directly to underground sewage conduit systems and is therefore fixed in position elevational wise. The cap 11 is spaced a selected distance downwardly from the surface 12 of roadway paving 13 on the road base material 14.

Access to the manhole pipe 10 is through a manhole cover 15 supported on the vertically adjustable manhole cover support frame or unit 20 provided in accordance with the present invention and which rests atop and is attached to the concrete cap 11. Cap 11, as will be noted from FIG. 2, is an annular member having a central open portion 11A. Cap 11 is not essential as direct connection, if desired, could be made with the conduit 10.

The adjustable unit 20 consists of a base unit 20A, a top unit 20B and vertically adjustable jack means 20C interconnecting the two.

The base unit 20A comprises a sleeve 21 that is open at its top end 22 and terminates at its bottom end 23 in an inwardly directed flange means 24. If desired the flange 24 can be positively anchored to the cap 11, for example as by anchor bolts 25. This flange provides an anchor base for screw jack adjusting means 20C to be described hereinafter and has an inner annular edge 24A.

The top unit 20B comprises of an annular top plate member 30 having concentric radially spaced apart annular walls 32 and 33 extending downwardly therefrom providing a first cavity means and inwardly thereof there is a second cavity means for the screw jacks. The spaced apart walls 32 and 33 provide respective spaced apart outer and inner wall surfaces 34 and 35 defining therebetween a cavity 36 that is open downwardly and telescopically receives therein the sleeve 21 of base member 20A. In the preferred form walls 32 and 33 are cylindrical.

Figure 3:
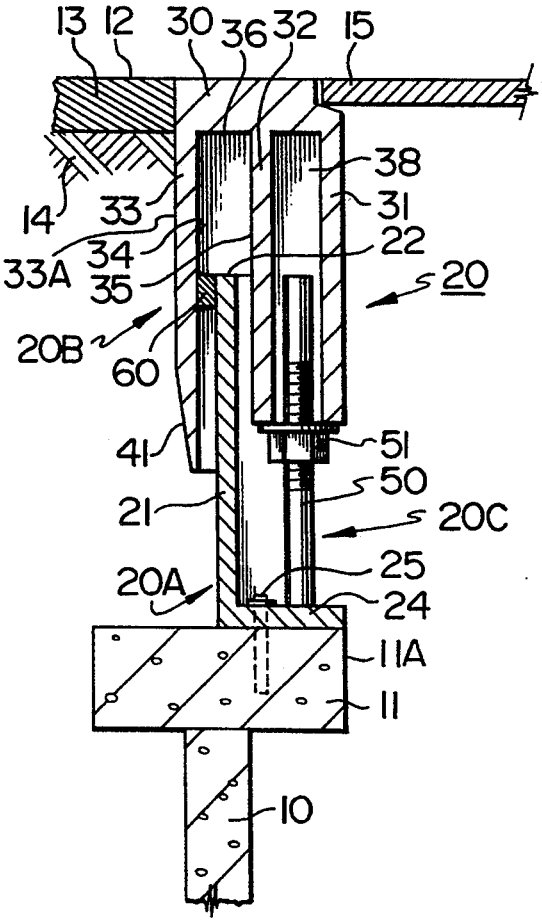
FIG. 3 is a sectional view along line 3—3 of FIG. 1.
Figure 4:
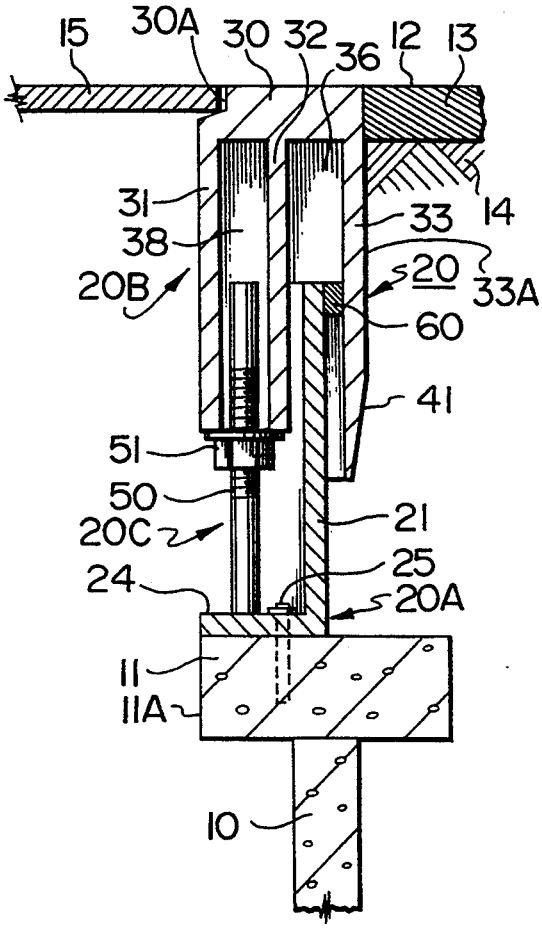
FIG. 4 is a sectional view along line 4—4 of FIG. 1.
Figure 5:
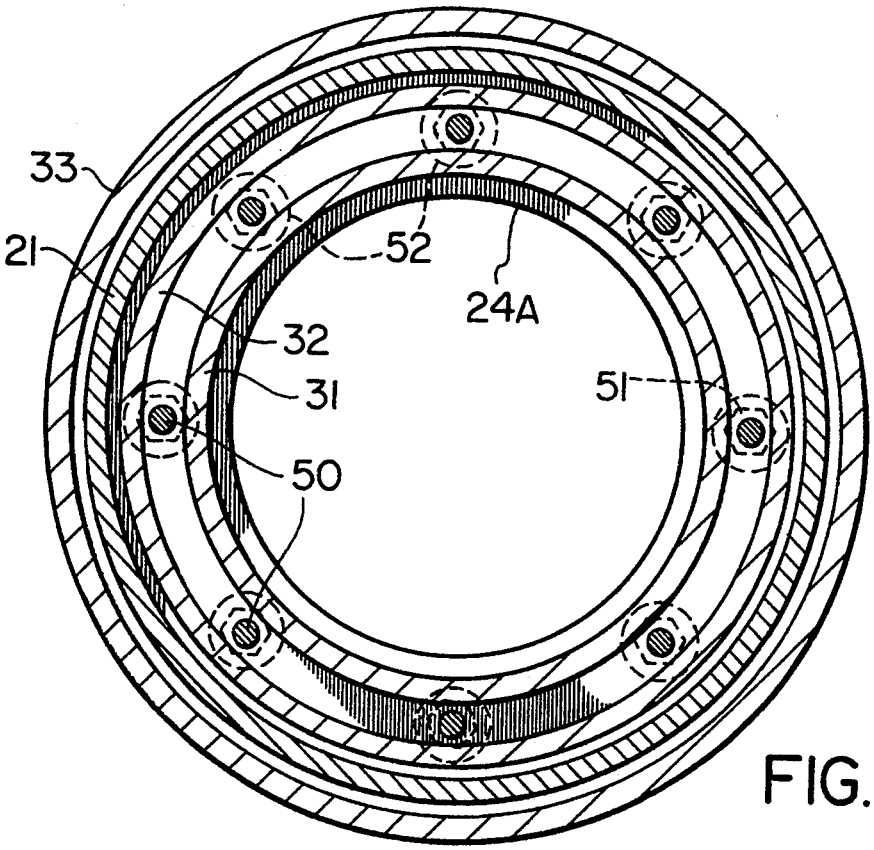
FIG. 5 is a sectional view along line 5—5 of FIG. 2.

In the embodiment illustrated in FIGS. 2, 3 and 4 there is an inner wall 31 spaced from wall 32 and the space therebetween defines a cavity 38 that is open only at its bottom end 39. A plurality of spaced apart threaded rods 50 project into the cavity 38 and each has a nut 51 threaded thereon that, through a plate or washer 52, acts against the undersurface of the bottom end of walls 31 and 32.

Figure 6:
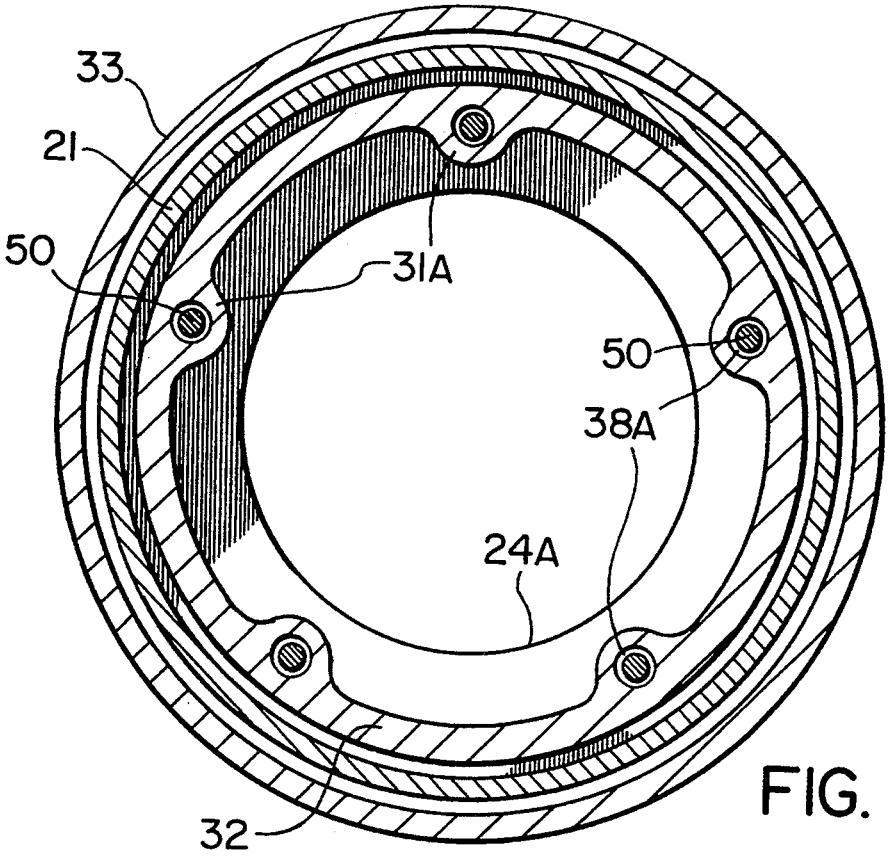
FIG. 6 is a view similar to FIG. 5 but illustrating a modification.

In another embodiment, illustrated in FIG. 6, flange 31 is replaced by a series of spaced apart flanges 31A, that effectively are protrusions from flange 32, (i.e. an enlargement in the wall thickness) for each of the respective individual screw jacks. In other words there are a number of individual cavities 38A spaced from one another circumferentially around the inner surface of unit 20B with there being one for each screw jack (i.e. bolt). The cavities are preferably equi-spaced and while most any number may be used, with the minimum being three, there are preferably five. It will be obvious this embodiment makes casting easier and reduces the amount of material required for the unit 20B. Each cavity is located in an enlargement in the wall thickness on a portion of the flange 32.

The threaded bolts are preferably securely anchored at their lower end to flange 24 as by for example being press fit into an aperture therein or alternatively welded thereto. The threaded bolts and nuts thereon provide screw jack means for selectively adjusting the elevational road height position of the top unit 20B. It will be obvious the top unit 20B can be readily raised or lowered by appropriately turning nuts 51 on the threaded rods so as to bring the upper surface of the removable cover plate 15 and flange 30 flush with the pavement surface 12.

The only openings in cavities 36 and 38 are in the bottom thereof. With the nuts on the rods being closely adjacent the bottom end of walls 31 and 32 they are relatively protected from the environmental hostile elements during use of the device. The overlapping portions of units 20A and 20B are protected from the hostile elements by virtue of the fact sleeve 31 of the unit 20A is telescopically received within the cavity 36 of the top unit 20B. An 0-ring seal 60 is mounted on one of wall surfaces 35 and outer surface of sleeve 31 and slidably engages the other to provide a smooth sliding fit and keep out unwanted debris.

The outer peripheral wall 33A of the flange 33 is cylindrical making it easy to slide through the substructure 14 and pavement 13 when adjustment is needed. Also the lower end of flange 33 tapers inwardly and downwardly as at 41 so that should lowering be necessary it is easily forced through the sub-structure 14. Also the outer peripheral surface of the top plate 30 is preferably flush with the outer surface 33A of flange 33. The plate 30 has a notch 30A that provides a seat for the cover 15.

I claim:

1. An adjustable manhole cover support frame comprising:

(a) a base unit having an open ended sleeve with flange means on a bottom end portion thereof, said flange means extending laterally from said sleeve and securable with respect to an upper end portion of a vertical manhole conduit means providing an upward extension thereof;

(b) a top manhole cover support unit adjustably supported on said base unit and having a first outer annular wall and a second inner wall, said inner and outer walls being spaced apart from one another and extending a selected distance downwardly from a top plate providing a first cavity on the underside of said top unit, said top plate having an opening therethrough surrounded by said inner wall and by a shoulder with such shoulder providing means to removably support a manhole cover, said first cavity telescopically receiving therein said annular sleeve of said base unit; said top unit having second cavity means adjacent and radially inwardly of said first cavity means; said second cavity means being open only at a bottom end thereof for screw jacks to project thereinto; and (c) screw jack means for selectively adjusting the relative telescopic position of said base unit and top unit; said screw jack means comprising a plurality of spaced apart rods slidably projecting through the bottom open end of said second cavity means each rod having a nut threaded thereon which acts against a bottom end of said top unit; each said rod having a lower end portion engaging said flange means on said base unit for support thereby.

2. The apparatus as defined in claim 1 wherein each of said top plate, first wall and second wall is annular and concentrically disposed with respect to one another.

3. An apparatus as defined in claim 2 wherein the outermost annular wall has an inwardly tapered outer surface on a terminal lower end portion thereof.

4. An apparatus as defined in claim 2 wherein each said rod is rigidly anchored to said laterally extending flange and wherein said rods project upwardly from such flange in spaced apart, parallel relation.

5. An adjustable support for a manhole cover comprising:

(a) a rigid base unit that has a lower plate with a sleeve projecting upwardly therefrom, said plate having a hole therethrough that is circumscribed by said sleeve;

(b) a top unit having an upper plate with walls depending downwardly therefrom providing a first cavity thereunder which is open at its bottom and telescopically receiving therein said upwardly projecting sleeve and a second cavity means, said second cavity means having being only in a bottom end thereof, said upper plate having an opening disposed generally centrally thereof surrounded by a ledge for removably supporting a manhole cover;

(c) screw jack means comprising a plurality of threaded rods engaging said lower plate and projecting upwardly therefrom, said rods projecting into said second cavity means through the open bottom thereof and threaded nut means acting against the bottom end of said top unit and coacting with said threaded rods providing means for selectively raising or lowering said top unit relative to said base unit so that a manhole cover on said top unit can be, in situ, brought flush with the adjacent road or ground surface.

6. The device of claim 5 wherein said second cavity means comprises an individual cavity for a respective one of each of said threaded rods and nuts, threaded onto said rods, engage a lower bottom end of said top unit.

7. The device of claim 6 wherein said second cavity means is radially inwardly of said first cavity means.

8. The device of claim 7 wherein said sleeve on said base unit and an outermost wall on said top unit are cylindrical.

9. The device of claim 8 wherein said walls defining said first cavity include a first outer cylindrical wall having an outer surface and an inner second wall spaced from said first wall and wherein said upper plate of said top unit is annular with an outer peripheral edge flush with said outer surface.

10. The device of claim 9 wherein said walls defining said second cavity include an inner cylindrical wall having an inner surface and wherein the removable cover has an outer diameter greater than the diameter of said inner wall and wherein said cover has an upper surface substantially flush with a top upper surface of said annular upper plate.

11. The device of claim 9 wherein said second cavity means is provided in enlargements in the wall thickness of second inner wall.

* * * * *